United States Patent [19]

Albinson et al.

[11] Patent Number: 4,913,797

[45] Date of Patent: Apr. 3, 1990

[54] CATALYST HYDROTREATING AND DEWAXING PROCESS

[75] Inventors: Kenneth R. Albinson, Audubon; Sadi Mizrahi; Daniel J. Neuman, both of Cherry Hill, all of N.J.

[73] Assignee: Mobil Oil Corporation, New York, N.Y.

[21] Appl. No.: 296,929

[22] Filed: Jan. 12, 1989

Related U.S. Application Data

[63] Continuation of Ser. No. 800,088, Nov. 21, 1985, abandoned, which is a continuation of Ser. No. 668,773, Nov. 6, 1984, abandoned.

[51] Int. Cl.[4] ..... C10G 65/04; C10G 65/12

[52] U.S. Cl. ..... 208/89; 208/18; 208/111

[58] Field of Search ..... 208/89, 111, 59

[56] References Cited

U.S. PATENT DOCUMENTS

| | | | |
|---|---|---|---|
| Re. 28,341 | 2/1975 | Wadlinger et al. | 208/120 |
| Re. 28,398 | 4/1975 | Chen et al. | 208/111 |
| 3,308,069 | 3/1967 | Wadlinger et al. | 502/64 |
| 3,393,148 | 7/1968 | Bertolacini et al. | 208/264 |
| 3,668,113 | 6/1972 | Burbidge et al. | 208/97 |
| 3,674,680 | 7/1972 | Hoekstra et al. | 208/111 |
| 3,709,979 | 1/1973 | Chu et al. | 423/328 |
| 3,728,249 | 4/1973 | Antezana | 208/57 |
| 3,730,879 | 5/1973 | Christman et al. | 208/210 |
| 3,764,520 | 10/1973 | Newton et al. | 208/111 |
| 3,764,565 | 10/1973 | Jacobs et al. | 252/470 |
| 3,814,683 | 6/1974 | Christman et al. | 208/216 |
| 3,841,995 | 10/1974 | Bertolacini et al. | 208/89 |
| 3,876,523 | 4/1975 | Rosinski et al. | 208/89 |
| 3,894,937 | 7/1975 | Bonacci et al. | 208/89 |
| 3,894,938 | 7/1975 | Gorring et al. | 208/97 |
| 3,902,991 | 9/1975 | Christensen et al. | 208/211 |
| 3,965,102 | 6/1976 | Hauck et al. | 260/286 |
| 3,983,029 | 9/1976 | White | 208/59 |
| 4,016,218 | 4/1977 | Haag et al. | 260/671 |
| 4,032,435 | 6/1977 | Lawrence et al. | 208/216 |
| 4,051,021 | 9/1977 | Hamner et al. | 208/216 |
| 4,069,139 | 1/1978 | Riley et al. | 208/216 |
| 4,073,718 | 2/1978 | Hamner | 208/80 |
| 4,210,521 | 7/1980 | Gorring et al. | 208/89 |
| 4,257,872 | 3/1981 | LaPierre | 208/59 |
| 4,298,458 | 11/1981 | Banta et al. | 208/89 |
| 4,344,840 | 8/1982 | Kunesh | 208/251 H |
| 4,358,362 | 11/1982 | Smith et al. | 208/91 |
| 4,377,468 | 3/1983 | LaPierre et al. | 208/111 |
| 4,383,913 | 5/1983 | Powell et al. | 208/59 |
| 4,395,327 | 7/1983 | Pelrine | 208/216 |
| 4,411,770 | 10/1983 | Chen et al. | 208/251 H |
| 4,419,218 | 12/1983 | Angevine et al. | 208/111 |
| 4,419,220 | 12/1983 | LaPierre et al. | 208/111 |
| 4,428,819 | 1/1984 | Shu et al. | 208/111 |
| 4,435,275 | 3/1984 | Derr et al. | 208/111 |
| 4,436,614 | 3/1984 | Olbrich et al. | 208/111 |
| 4,486,296 | 12/1984 | Oleck et al. | 208/89 |
| 4,500,415 | 2/1985 | Simo et al. | 208/59 |
| 4,510,044 | 4/1985 | Oleck et al. | 208/111 |
| 4,518,485 | 5/1985 | LaPierre et al. | 208/89 |
| 4,554,065 | 11/1985 | Albinson et al. | 208/59 |
| 4,592,828 | 6/1986 | Chu et al. | 208/217 |
| 4,597,854 | 7/1986 | Penick | 208/59 |

*Primary Examiner*—Anthony McFarlane

*Attorney, Agent, or Firm*—Alexander J. McKillop; Charles J. Speciale; Malcolm D. Keen

[57] ABSTRACT

The present invention is directed to a cascade catalytic hydrotreating/dewaxing process, wherein a hydrocarbon feedstock containing waxy components is treated. The hydrotreating phase precedes the dewaxing phase in order to remove contaminants, such as nitrogen and sulfur, from the feedstock to prolong the life of the catalyst used in the subsequent dewaxing step. A conventional hydrotreating catalyst is used. The dewaxing catalyst is a Zeolite Beta catalyst. The cascade process is conducted with or without interstage gas separation. The treatment occurs in the same or in separate reactors. The ratio of hydrotreating catalyst to dewaxing catalyst is greater than 1:2. This sequence of treatments enhances distillate yields and lowers processing and capital costs.

19 Claims, 1 Drawing Sheet

PROCESS FOR CASCADE WITHOUT INTERSTAGE GAS PURIFICATION

PROCESS FOR CASCADE WITHOUT INTERSTAGE GAS PURIFICATION

PROCESS FOR CASCADE WITHOUT INTERSTAGE GAS PURIFICATION

CATALYST HYDROTREATING AND DEWAXING PROCESS

This is a continuation of copending application Ser. No. 800,088 filed on Nov. 21, 1985 now abandoned, which is a continuation of copending application Ser. No. 668,773, filed on Nov. 6, 1984, now abandoned.

FIELD OF THE INVENTION

The present invention is directed to a cascade process for catalytically hydrotreating and catalytically dewaxing petroleum stock. The present invention is particularly directed to a two-catalyst, cascade hydrotreating and dewaxing process. This new process reduces pour point and obtains an improved pour point for and high yield of middle and heavy distillate at relatively mild operating conditions.

BACKGROUND OF THE INVENTION

Hydrotreating

The use of hydrotreating (HDT) to upgrade hydrocarbon fractions for use as charge stocks for catalytic cracking was well known in the art by the 1960's. Hydrotreating, as used herein, is meant to encompass those processes using hydrogen in the presence of catalysts in order to remove undesirable compounds from hydrocarbons, that is, to upgrade the hydrocarbons.

By 1960, it was recognized that hydrotreatment could be used for demetalation, desulfurization, Conradson Cabon Residue reduction and denitrogenation. There was universal recognition at that time in the art that hydrogenation catalysts comprising Group VI (Cr, Mo, W) and Group VIII metals or their oxides or sulfides deposited on porous refractory supports were extremely useful in hydrotreating processes. Preferred catalysts for hydrotreating were considered to be cobalt-molybdate or nickelmolybdate supported on alumina. These catalysts are generally referred to as "conventional HDT catalysts."

The pore size distribution of the HDT catalyst is a very important parameter in determination of the activity of the catalyst. Large pore catalysts generally possess greater demetalating activity and smaller pore catalysts generally possess lower demetalation activity, but higher desulfurization activity. U.S. Pat. No. 3,730,879 teaches an HDT process comprising a multi-layered arrangement of catalyst with different pore distributions. In the first bed, there is used a smaller pore catalyst which is more selective for desulfurization; and in the second downstream bed, there is used a larger pore catalyst which is more selective for removal of metal contaminants. According to U.S. Pat. No. 3,730,879, the desulfurization catalyst of the first bed has a catalyst characterized by a pore diameter distribution as follows: less than 25% 0–100 A; greater than 50% 100–200 A; and the remainder 200–600 A. The demetalation catalyst of the second bed has a catalyst characterized by a pore diameter distribution as follows: less than 20% 0–100 A; less than 45% 100–200 A; and balance 200–600 A.

The average pore diameter size for HDT catalysts in desulfurization processes is usually 100–200 A. Such average pore diameter size is disclosed in U.S. Pat. Nos. 3,393,148; 3,674,680; 3,764,565; 3,841,995 and 3,882,049.

Processes for the demetalation and desulfurization of oil fractions using conventional HDT catalysts with at least 60% of its pore volume in pores of 100 A to 200 A diameter and at least 5% of its pore volume in pores having diameters greater than 500 A are disclosed in U.S. Pat. Nos. 3,876,523 and 4,016,067.

U.S. Pat. No. 3,902,991 discloses a hydrodesulfurization process for oil fractions which uses a conventional HDT catalyst having at least 50% of its total pore volume in pores having a diameter size range of 65 to 150 A. Another hydrodesulfurization process for oil fractions is described in U.S. Pat. No. 3,730,879, wherein one of the catalysts has at least 50% of its total pore volume in pores having radii in the size range of 50–100 A. Still another hydrodesulfurization process is disclosed in U.S. Pat. No. 3,814,683. In this patent, the conventional HDT catalyst is characterized by having at least 65% of its total pore volume in pores having a diameter size of 80–180 A.

Other hydrodesulfurization processes using a conventional HDT catalyst having a specific pore size distribution are disclosed in U.S. Pat. Nos. 4,032,435; 4,051,021; 4,069,139 and 4,073,718.

Dewaxing

Processes for dewaxing petroleum distillates have been known for a long time. Dewaxing is, as is well known, required when highly paraffinic oils are to be used in products which need to remain fluid at low temperatures, e.g., lubricating oils, heating oils, jet fuels, petroleum stocks. The higher molecular weight straight chain normal and slightly branched paraffins, which are present in oils of this kind, form wax which are the cause of high pour points in the oils. If adequately low pour points are to be obtained, these waxes must be wholly or partly removed. In the past, various solvent removal techniques were used, e.g., propane dewaxing, MEK dewaxing. But, the decrease in demand for petroleum waxes as such, together with the inceased demand for gasoline and distillate fuels, has made it desirable to find processes which not only remove the waxy components but which also convert these components into other materials of higher value. Catalytic dewaxing processes achieve this end by selectively cracking the longer chain n-paraffins to produce lower molecular weight products, which may be removed by distillation. Processes of this kind are described, for example, in *The Oil and Gas Journal*, Jan. 6, 1975, pages 69 to 73 and U.S. Pat. No. 3,668,113.

The dewaxing of oils by shape selective cracking and hydrocracking over ZSM-5 zeolites is discussed and claimed in Re. 28,398 to Chen et al. U. S. Patent No. 3,965,102 discloses a particular method for dewaxing a petroleum distillate with a ZSM-5 catalyst. Typical aging curves are shown in sheet 2 of the drawing of the 3,965,102 patent. U. S. Patent No. 3,894,938 to Gorring et al discloses that the cycle life of a ZSM-5 dewaxing catalyst is longer with a virgin feed stream than it is with the same feedstream after it has been hydrotreated. Catalytic dewaxing of petroleum stocks in which a mordenite type of molecular sieve catalyst is used is described in *The Oil and Gas Journal*, Jan. 6, 1975 issue at pages 69–73. See also U.S. Pat. No. 3,668,113. All of the foregoing patents and the literature reference are hereby incorporated by reference.

Crystalline zeolite ZSM-11 is disclosed and claimed in U.S. Pat. No. 3,709,979.

U.S. Pat. No. 3,769,202 teaches catalytic conversion of hydrocarbons using as a catalyst two different crystalline aluminosilicate zeolites, one having a pore size greater than 8 Angstroms and the other having a pore size of less than 7 Angstroms. This reference teaches that a conventional hydrogenation/dehydrogenation component may be added, in an amount from about 0.01 to about 30 wt. %. This reference teaches (Example 32) a mixture of zeolite X and sodium mordenite and 10 parts of clay dispersed in a silica-alumina matrix.

U.S. Pat. No. 3,764,520 teaches hydrocracking with a catalyst mixture of large and small pore crystalline zeolites. Catalyst E consists of five parts hydrogen-erionite plus five parts of hydrogen-faujasite dispersed in 90 parts of silica/alumina.

Isomerization dewaxing with a class of large pore zeolites is disclosed in copending U.S. Patent Application No. 379,423, now abandoned.

U.S. Pat. No. 4,419,220 describes a dewaxing process utilizing a Zeolite Beta catalyst, which patent is hereby incorporated by reference.

Copending U.S. Patent Application, Ser. No. 614,072, now abandoned describes a dewaxing catalyst comprising, in combination, a medium pore zeolite and Zeolite Beta in the presence of an hydrogenation component, with reference is hereby incorporated by reference.

Copending U.S. Pat. Application, Ser. No. 631,681, now U.S. Pat. No. 4,575,416 hereby incorporated by reference, describes a dewaxing catalyst and process using a mixed zeolite hydrodewaxing catalyst, e.g., a mixture of ZSM-5 and Zeolite Beta, mixed together, with a hydrogenation component for catalytic dewaxing.

U.S. Pat. No. 4,383,913 discloses a cascade process wherein the hydrocarbon feed first passes over a bed of zeolite containing catalyst, and then over a bed of amorphous catalyst.

U.S. Pat. No, 3,894,937 discloses a dual catalyst converter and process, suitable for cascade processing.

It is also known that the catalytic activity of some dewaxing processes can be improved by removing impurities from the feed.

U.S. Pat. No. 4,358,362, the entire contents of which is incorporated herein reference, teaches enhancing catalytic activity of a dewaxing process by subjecting the feed to the dewaxing process to treatment with a zeolite sorbent. It was thought that the use of a zeolite sorbent would absorb more of the zeolite's specific poisons present in the feed than would a clay pretreament of the feed.

It is also known to produce lubricating oil of improved properties of hydrotreating the lubricating oil base stock in the presence of ZSM-39 containing Co-Mo, as shown in U.S. Pat. No. 4,395,327, the entire contents of which is incorporated herein by reference.

Despite all the advances that have been made in catalytic hydrodewaxing, it would still be very beneficial to devise a process which would give higher yields of valuable products, while requiring lower process and capital costs than obtained or required by the prior art.

We have discovered a unique processing sequence for hydrotreating and dewaxing which achieves this goal.

SUMMARY OF THE INVENTION

Accordingly, the present invention provides a cascade catalytic hydrotreating/dewaxing process wherein a hydrocarbon feed stock containing waxy components, like normal paraffins and slightly branched chain paraffins, is treated. The hydrotreating phase precedes the dewaxing phase in order to first remove contaminates such as nitrogen and sulfur from the feed stock to lower the temperature requirement in a subsequent dewaxing step, and to prolong the life of the dewaxing catalyst employed. The hydrotreating step uses a conventional hydrotreating catalyst. The dewaxing step employs a Zeolite Beta catalyst. The cascade process can be conducted in the same or in separate reactors. The treatments occur with or without interstage gas separation. This sequence of treatments enhances distillate yields and lowers processing and capital costs. At the same overall space velocity, the two-catalyst cascade system gives either higher distillate yields or lower temperature requirement, or both, for dewaxing than platinum Zeolite Beta catalyst alone. Thus, in effect, partially replacing (sutstituting) platinum Zeolite Beta by a hydrotreating catalyst improves performance. Generally it is desirable to have $H_2$ partial pressures higher than 400 psi in the hydrotreating zone and lower than 400 psi in the dewaxing zone. Since this is not possible when both catalysts are in the same vessel or where equipment limitations exist, it may be necessary to operate the two zones at approximately equal $H_2$ partial pressures. The present invention relates to an optimum catalyst ratio when the process is operated with approximately equal $H_2$ partial pressures in both catalyst zones.

The invention particularly relates to a cascade process for dewaxing a hydrocarbon feedstock with a relatively high pour point and containing paraffins, like normal and slightly branched paraffins, and sulfur and nitrogen compounds comprising:

A. Subjecting said feedstock to hydrotreating by contacting said feedstock with a hydrotreating catalyst in a hydrotreating zone operated at hydrotreating conditions sufficient to remove at least a portion of said sulfur and nitrogen compounds from the feedstock;

B. Subjecting said hydrotreated feedstock to catalytic dewaxing without changing the $H_2$ partial pressure by contacting said feedstock with a catalyst in a dewaxing zone containing Zeolite Beta and containing a hydrogenation/dehydrogenation component, the ratio of the catalyst in the hydrotreating zone to the catalyst in the dewaxing zone being less than 2:1. The hydrogen partial pressure at the inlet to the dewaxing zone may also be adjusted to the same hydrogen partial pressure at the inlet of the hydrotreating zone;

C. Recovering a distillate having a reduced pour point compared to said feedstock.

The process, more particularly, relates to a cascade process for dewaxing a hydrocarbon feedstock with a relatively high pour point and containing at least 10 wt % waxy paraffins, like normal paraffins and slightly branched paraffins, and sulfur and nitrogen compounds comprising:

A. Subjecting said feedstock to hydrotreating by contacting said feedstock with a hydrotreating catalyst in an hydrotreating zone, operated at a temperature of about 600°–850° F. (315°–455° C.), a hydrogen partial pressure of about 200 to 1000 psia (1480–7000 kPa), and a liquid hourly space velocity of about 0.1 to 5, to remove at least a portion of said sulfur and nitrogen compounds from the feedstock;

B. Subjecting said hydrotreated feedstock to catalytic dewaxing without changing the hydrogen partial pressure by contacting said feedstock with a catalyst in a dewaxing zone containing Zeolite Beta and containing a hydrogenation/dehydrogenation component, including a temperature of about 600°–850° F. (315°–455° C.), a hydrogen partial pressure of about 200 to 1000 psia (1480–7000kPa), and a liquid hourly space velocity of about 0.1 to 5, the ratio of the catalyst in the hydrotreating zone to the catalyst in the dewaxing zone begin about 1:2. The hydrogen partial pressure at the inlet of the dewaxing zone may also be adjusted to the same hydrogen partial pressure at the inlet of the hydrotreating zone.

C. Recovering a reduced pour point distillate, compared to said feedstock, of middle and heavy distillates.

Regarding the dewaxing process, the process can use either hydrocracking or hydroisomerization reactions.

Features of the present invention will be described in connection with the accompanying drawing which depict flow diagrams of the present cascade process. The features described in the drawings are illustrative and are not considered to limit the present invention. The drawings contain the following figures:

DESCRIPTION OF THE INVENTION

Feedstock

Figure 1:
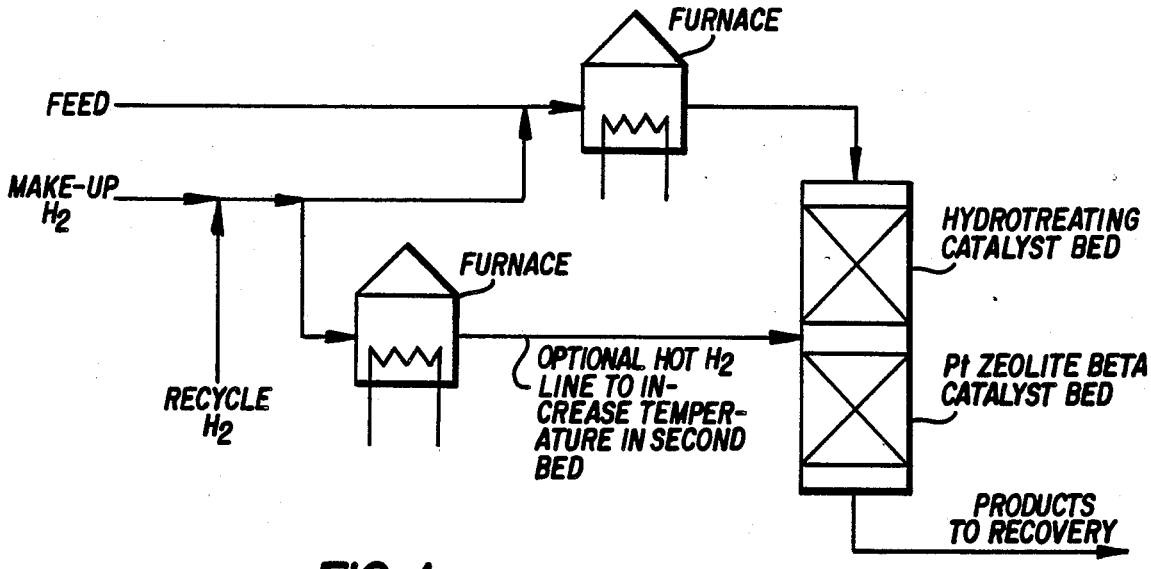
FIG. 1 shows a process configuration where the catalysts are arranged as a dual bed without intercatalyst gas separation.

The present process may be used to hydrotreat and to dewax a variety of feedstocks ranging from relatively light distillate fractions up to high boiling stocks, such as whole crude petroleum, reduced crudes, vacuum tower residua, cycle oils, FCC tower bottoms, gas oils, vacuum gas coils, deasphalted residua and other heavy oils. The feedstock will normally be a $C_{10}+$ feedstock because lighter oils will usually be free of significant quantities of waxy components. However, the process is particularly useful with waxy distillate stocks, such as gas oils, cracked oils, diesel oil, kerosenes, jet fuels, lubricating oil stocks, heating oils and other distillate fractions whose pour point and viscosity need to be maintained within certain specification limits. Lubricating oil stocks will generally boil above 230° C. (450° F.), more usually above 315° C. (600° F.). Hydrocracked stocks are a convenient source of stocks of this kind and also of other distillate fractions because they normally contain significant amounts of waxy n-paraffins which have been produced by the removal of polycyclic aromatics. The feedstock for the present process will normally be a $C_{10}+$ feedstock containing paraffins, olefins, naphthenes, aromatics and heterocyclic compounds and with a substantial proportion of higher molecular weight n-paraffins and slightly branched paraffins which contribute to the waxy nature of the feedstock. During the process, the n-paraffins become isomerized to iso-paraffins and the slightly branched paraffins undergo isomerization to more highly branched aliphatics. At the same time, a measure of cracking does take place so that not only is the pour point reduced by reason of the isomerization of n-paraffins to the less waxy branched chain iso-paraffins but, in addition, the heavy ends undergo some cracking or hydrocracking to form liquid range materials which contribute to a low pour point product. The degree of cracking which occurs is, however, limited so that the gas yield is reduced, thereby preserving the economic value of the feedstock.

Typical feedstocks include light gas oils, heavy gas oils and reduced crudes boiling above 150° C. (300° F.).

Feedstocks containing aromatics, e.g., 10 percent or more aromatics, may be successfully dewaxed. The aromatic content of the feedstock will depend, of course, upon the nature of the crude employed and upon any preceding processing steps, such as hydrocracking, which may have acted to alter the original proportion of aromatics in the oil. The aromatic content will normally not exceed 50% by weight of the feedstock and more usually will be not more than 10–30% by weight, with the remainder consisting of paraffins, olefins, naphthenes and heterocyclics. The paraffin content (normal and iso-paraffins) will generally be at least 10% by weight, more usually at least 20% by weight.

The feedstock, prior to hydrotreating, may contain up to 30,000 wt ppm sulfur, and up to 20,000 wt ppm nitrogen, and at least 10% by weight waxy components, like normal paraffins and slightly branched chain paraffins.

HYDROTREATING CATALYST AND PROCESS

Any conventional hydrotreating catalyst and processing conditions may be used.

Preferably the hydrotreating process uses a catalyst containing a hydrogenation component on a support, preferably a non-acidic support, e.g., Co-Mo, Ni-Mo or Ni-W on alumina.

The hydrotreating catalyst may be disposed as a fixed, fluidized, or moving bed, though down flow, fixed bed operation is preferred because of its simplicity. When the hydrotreating catalyst is disposed as a fixed bed of catalyst, the liquid hourly space velocity, or volume per hour of liquid feed measured at 20° C. (68° F.) per volume of catalyst will usually be in the range of about 0.1–10, and preferably about 0.1–5. In general, higher space velocities or throughputs require higher temperature operation in the reactor to produce the same amount of hydrotreating.

The hydrotreating operation is enhanced by the presence of hydrogen, and typically hydrogen partial pressues of 200 psia (1480 kPa) to 2,000 psia (13900 kPa) are employed, and more typically 200 to 1000 psia (1480 to 7000 kPa) are employed. Hydrogen can be added to the feed on a once through basis, with the hydrotreater effluent being passed directly to the dewaxing zone.

Alternatively, the hydrotreater effluent is cooled, and the hydrogen rich gas phase is purified to remove sulfur and nitrogen compounds from the gas.

Other suitable hydrogenation components include one or more of the metals, or compounds thereof, from Groups II, III, IV, V, VIB, VIIB, VIII and mixtures thereof of the Periodic Table of the Elements (the Periodic Table used in this specification is the table approved by IUPAC and the U. S. National Bureau of Standards and is known, for example, as the table of the Fisher Scientific Company, Catalog No. 5-702-10). Preferred metals include molybdenum, tungsten, vanadium, chromium, cobalt, titanium, iron, nickel and mixtures thereof.

Usually the hydrotreating metal component will be present on a support in an amount equal to 1–30% by weight of the support, with operation with 5–25% by weight hydrogenation metal, on an elemental basis, giving good results.

The hydrogenation components are usually disposed on a support, such as silica, alumina, silica-alumina, etc. Any other conventional support material may also be used. It is also possible to include on the support an acid acting component, such as an acid exchange clay or a zeolite.

Preferably, the hydrotreating catalyst does not have much acidity because it is the intent of the present invention to primarily conduct hydrotreating in the hydrotreating zone and minimize cracking or other reactions therein.

ZEOLITE BETA CATALYST AND PROCESS

As mentioned above, the present hydrocarbon conversion process uses a conventional Zeolite Beta catalyst. Zeolite Beta is described in U.S. Pat. No. Re. 28,341, and reference is made to this patent for details of the zeolite and its preparation. Zeolite Beta is a crystalline aluminosilicate zeolite having a pore size greater than 5 Angstroms. The term "zeolite" or "zeolite material" as used herein means the crystalline zeolitic aluminosilicates referred to above.

A more detailed description of Zeolite Beta may be found in U.S. Patent Application No. 379,421, which is hereby incorporated by reference.

The composite of the zeolite as described in U.S. Pat. No. Re. 28,341, in its as synthesized form, may be expressed as follows:

$$[XNa(1.0\pm0.1-X)TEA]AlO_2.YSiO_2.WH_2O$$

where X is less than 1, preferably less than 0.7; TEA represents the tetraethylammonium ion; Y is greater than 5 but less than 100 and W is up to about 60 (it has been found that the degree of hydration may be higher than originally determined where W was defined as being up to 4), depending on the degree of hydration and the metal cation present. The TEA component is calculated by differences from the analyzed value of sodium and theoretical cation to structural aluminium ratio of unity.

In the fully base-exchanged form, Zeolite Beta has the composition:

$$\left[\frac{x}{n}M(1\pm)\cdot 1-X)H\right].AlO_2.YSiO_2.WH_2O$$

where X, Y and W have the values listed above and n is the valence of the metal M.

In the partly base-exchanged form, which is obtained from the initial sodium form of the zeolite by ion exchange without calcining, Zeolite Beta has the formula:

$$\left[\frac{x}{n}M(1\pm0.1-X)TEA\right]AlO_2.YSiO_2.WH_2O$$

When it is used in the present catalyst, the zeolite is at least partly in the hydrogen form in order to provide the desired acidic functionality for the cracking reactions which are to take place. It is normally preferred to use the zeolite in a form which has sufficient acidic functionality to give it an alpha value of 1 or more. The alpha value, a measure of zeolite acidic functionality, is described, together with details of its measurement, in U.S. Pat. No. 4,016,218 and in J. Catalysis, Vol. VI, pages 278–287 (1966), and reference is made to these for such details. The acidic functionality may be controlled by base exchange or zeolite, especially with alkali metal cations such as sodium, by steaming or by control of the silica:alumina ratio of the zeolite.

When synthesized in the alkali metal form, Zeolite Beta may be converted to the hydrogen form by formation of the intermediate ammonium form as a result of ammonium ion exchange and calcination of the ammonium form to yield the hydrogen form. In addition to the hydrogen form, other forms of the zeolite, wherein the original alkali metal has been reduced to less than about 1.5% by weight, may be used. Thus, the original alkali metal of the zeolite may be replaced by ion exchange with other suitable metal cations including, by way of example, nickel, copper, zinc, palladium, calcium or rare earth metals.

Zeolite Beta, in addition to possessing a composition as defined above, may also be characerized by its X-ray diffraction data, which are set out in U. S. Patent Nos. 3,308,069 and Re. 28,341. The significant d values (angstroms, radiation; K alpha doublet of copper, Geiger counter spectrometer) are as shown in the d Value Table below:

d VALUE TABLE 1

| d Values of Reflections in Zeolite Beta |
|---|
| 11.40 + 0.2 |
| 7.40 + 0.2 |
| 6.70 + 0.2 |
| 4.25 + 0.1 |
| 3.97 + 0.1 |
| 3.00 + 0.1 |
| 2.20 + 0.1 |

The preferred forms of zeolite beta for use in the present process are the high silica forms, having a silica:alumina ratio of at least 30:1.

The silica:alumina ratios referred to in this specification are the structural or framework ratios, that is, the ratios of $SiO_4$ to the $A10_4$ tetrahedra which together constitute the structure of which the zeolite is composed. It should be understood that this ratio may vary from the silica:alumina ratio determined by various physical and chemical methods. For example, a gross chemical analysis may include aluminum which is present in the form of cations associated with the acidic sites on the zeolite, thereby giving a low silica:alumina ratio. Similary, if the ratio is determined by the thermogravimetric analysis (TGA) of ammonia desorption, a low ammonia titration may be obtained if cationic aluminum prevents exchange of the ammonium ions onto the acidic sites. These disparities are particularly troublesome when certain treatments, such as the dealuminization method described below which result in the presence of ionic aluminum free of the zeolite structure, are employed. Due care should therefore be taken to ensure that the framework silica:alumina ratio is correctly determined.

The silica:alumina ratio of the zeolite may be determined by the nature of the starting materials used in its preparation and their quantities relative one to another. Some variation in the ratio may therefore be obtained by changing the relative concentration of the silica precursor relative to the alumina precursor, but definite limits in the maximum obtainable silica:alumina ratio of the zeolite may be observed. For Zeolite Beta, this limit is usually about 280:1 (although higher ratios may be obtained), and for ratios above this value, other methods are usually necessary for preparing the desired high silica zeolite. One such method comprises dealumination by extraction with acid and this method is disclosed in detail in U.S. Patent Application Ser. No. 379,399, by R. B. LaPiere and S. S. Wong, entitled "High Silica Zeolite Beta", and reference is made to this application for additional details of the method.

Briefly, the method comprises contacting the zeolite with an acid, preferably a mineral acid such as hydrochloric acid. The dealumination proceeds readily at ambient and mildly elevated temperatures and occurs with minimal losses in crystallinity to form high silica forms of Zeolite Beta with silica: alumina ratios of at least 100:1, with ratios of 200:1 or even higher being readily attainable.

The zeolite is conveniently used in the hydrogen form for the dealumination process, although other cationic forms may also be employed, for example, the sodium form. If these other forms are used, sufficient acid should be employed to allow for the replacement by portions of the original cations in the zeolite. The amount of zeolite in the zeolite/acid mixture should generally be from 5–60% by weight.

The acid may be a mineral acid, i.e., an inorganic acid or an organic acid. Typical inorganic acids which can be employed include mineral acids such as hydrochloric, sulfuric, nitric and phosphoric acids, peroxydisulfonic acid, dithionic acid, sulfamic acid, peroxymonosulfuric acid, amidodisulfonic acid, nitrosulfonic acid, chlorosulfuric acid, pyrosulfuric acid, and nitrous acid. Representative organic acids which may be used include formic acid, trichloroacetic acid, and trifluoroacetic acid.

The concentration of added acid should be such as not to lower the pH of the reaction mixture to an undesirably low level which could affect the crystallinity of the zeolite undergoing treatment. The acidity which the zeolite can tolerate will depend, at least in part, upon the silica/alumina ratio of the starting material. Generally, it has been found that Zeolite Beta can withstand concentrated acid without undue loss in crystallinity but, as a general guide, the acid will be from 0.1 N to 4.0 N, usually 1 to 2 N. The values hold good regardless of the silica:alumina ratio of the Zeolite Beta starting material. Stronger acids tend to effect a relatively greater degree of aluminum removal than weaker acids.

The dealuminization reaction proceeds readily at ambient temperatures but mildly elevated temperatures may be employed, e.g., up to 100° C. (212° F.). The duration of the extraction will affect the silica:alumina ratio of the product because extraction being diffusion controlled, is time dependent. However, because the zeolite becomes progressively more resistant to loss of crystallinity as the silica:alumina ratio increases, i.e., it becomes more stable as the alumina is removed, higher temperatures and more concentrated acids may be used towards the end of the treatment than at the beginning without the attendant risk of losing crystallinity.

After the extraction treatment, the product is water washed free of impurities, preferably with distilled water, until the effluent wash water has a pH within the approximate range of 5–8.

The crystalline dealuminized products obtained by this method have substantially the same crystallographic structure as that of the starting aluminosilicate zeolite, but with increased silica:alumina ratios. The formula of the dealuminized Zeolite Beta will therefore be $$\left[\frac{X}{n}M(1 \pm 0.1 - X)H\right]AlO_2.YSiO_2.WH_2O$$

where X is less than 1, preferably less than 0.75, Y is at least 100, preferably at least 150 and W is up to 60. M is a metal, preferably a transition metal or a metal of Groups IA, 2A or 3A of the Periodic Table, or a mixture of metals. The silica:alumina ratio Y will generally be in the range of 100:1 to 500:1, more usually 150:1 to 300:1, e.g., 200:1 or more. The X-ray diffraction pattern of the dealuminized zeolite will be substantially the same as that of the original zeolite, as set out in Table 1 above.

If desired, the zeolite may be steamed prior to acid extraction so as to increase the silica:alumina ratio and render the zeolite more stable to the acid. The steaming may also serve to increase the ease with which the acid is removed and to promote the retention of crystallinity during the extraction procedure.

The Zeolite Beta is preferably used in combination with a hydrogenation component comprising 0.1–20% by weight on an elemental basis, which is usually derived from a metal of Groups VA, VIA or VIIIA of the Periodic Table. Preferred non-noble metals are such as tungsten, vanadium, molybdenum, nickel, cobalt, chromium, and manganese, and the preferred noble metals are platinum, palladium, iridium and rhodium. The hydrogenation component comprises 0.1–5% by weight on an elemental basis of platinum or palladium, or both, or comprises 0.1–20% by weight on an elemental basis of nickel or tungsten, or both. Combinations of non-noble metals, such as cobalt-molybdenum, cobalt-nickel, nickel-tungsten or cobalt-nickel-tungsten, are useful with many feedstocks and the hydrogenation component is about 0.7 to about 7% by weight of nickel and about 2.1 to about 21% by weight of tungsten, expressed as metal. The hydrogenation component can be exchanged onto the zeolite, impregnated into it or physically admixed with it. If the metal is to be impregnated into or exchanged onto the zeolite, it may be done, for example, by treating the zeolite with platinum metal-containing ion. Suitable platinum compounds include chloroplatinic acid, platinous chloride and various compounds containing the platinum amine complex.

The catalyst may be treated by conventional presulfiding treatments, e.g., by heating in the presence of hydrogen sulfide, to convert oxide forms of the metals, such as CoO or NiO, to their corresponding sulfides.

The metal compounds may be either compounds in which the metal is present in the cation of the compound and compounds in which it is present in the anion of the compound. Both types of compounds can be used. Platinum compounds, in which the metal is in the form of a cation or cationic complex, e.g., $Pt(NH_3)_4Cl_2$, are particularly useful, as are anionic complexes, such as the vanadate and metatungstate ions. Cationic forms of other metals are also very useful because they may be exchanged onto the zeolite or impregnated into it.

Prior to use, the zeolite should be dehydrated at least partially. This can be done by heating to a temperature in the range of 200°–600° C. (390°–1110° F.) in air or an inert atmosphere, such as nitrogen, for 1 to 48 hours. Dehydration can also be performed at lower temperature merely by using a vacuum, but a longer time is required to obtain a sufficient amount of dehydration.

It may be desirable to incorporate the catalyst in another material resistant to the temperature and other conditions employed in the process. Such matrix materials include synthetic and naturally occurring substances, such as inorganic materials, e.g., clay, silica and metal oxides. The latter may be either naturally occurring or in the form of gelatinous precipitates or gels, including mixtures or silica and metal oxides. Naturally occurring clays can be composited with the zeolite, including those of the montmorillonite and kaolin families. The clays can be used in the raw state as originally mined or initially subjected to calcination, acid treatment or chemical modification.

The zeolite may be composited with a porous matrix material, such as alumina, silica-alumina, silica-magnesia, silica-zirconia, silica-thoria, silica-berylia, silica-titania, as well as terniary compositions, such as silica-alumina-thoria, silica-alumina-zirconia, magnesia and silica-magnesia-zirconia. The matrix may be in the form of a cogel. The relative proportions of zeolite component and inorganic oxide gel matrix on an anhydrous basis may vary widely with the zeolite content ranging from 10–99% by weight, more usually 25–80% by weight, of the dry composite. The matrix itself may possess catalytic properties, generally of an acidic nature.

Process Conditions

Processing is carried out under conditions similar to those used for conventional hydrocracking although the use of the highly siliceous zeolite catalyst permits the pressure requirements to be reduced. Process temperatures of about 550°–900° F. (285°–485° C.) may be used conveniently for hydrotreating or dewaxing. Generally, temperatures of about 600°–900° F., (315°–485° C.) preferably about 650°–850° F. (340°–455° C.) will be employed. The hydrogen partial pressure for both hydrotreating and dewaxing is usually in the range of about 200–2000 psia (1480–13,900 kPa), and the lower pressures within this range, about 200–1000 psia (1480–7000 kPa), will normally be preferred. These pressure ranges are critical. The ratio of hydrogen to the hydrocarbon feedstock (hydrogen circulation rate) will normally be from about 250–10,000 (42–1685 $n.m^3/m^3$), preferably about 500–4,000 SCF/bbl (84–675 $n.m^3/m^3$). The space velocity of the feedstock, for either hydrotreating or dewaxing, will normally be from about 0.1–10 $hr^{-1}$ LHSV, preferably about 0.1–5 $hr^{-1}$ LHSV. The product is high in fractions boiling above about 300° F. (150° C.). The pour point of the product is significantly reduced, compared to the pour point of the feedstock.

The process may be conducted by contacting the feedstock with a fixed stationary bed of catalyst, a fixed fluidized bed or with a transport bed. A simple configuration is a trickle-bed operation, in which the feed is allowed to trickle through a stationary fixed bed. With such a configuration, it is desirable to initiate the reaction with fresh catalyst at a moderate temperature which is of course raised as the catalyst ages inorder to maintain catalytic activity. The catalyst may be regenerated by contact at elevated temperature with hydrogen gas, for example, or by burning in air or other oxygen-containing gas.

The preliminary hydrotreating step removes nitrogen and sulfur and saturates aromatics to naphthenes without substantial boiling range conversion, improves catalyst performance and permits lower temperatures, higher space velocities, lower pressures or combinations of these conditions to be employed in the dewaxing zone while increasing or maintaining distillate yields.

Cascade Reaction System

By cascade operation is meant that at least about 50%, and preferably all, of the material passed over the HDT catalyst is also passed over the Zeolite Beta catalyst. There may or may not be intermediate separation or cooling of fluid going from one reaction zone to the next.

In its simplest form, a cascade operation may be achieved by using a large downflow reactor, wherein the lower portion contains the Zeolie Beta catalyst and the upper portion contains the HDT catalyst.

Two or more reactors in series may also be used, e.g., when a three reactor system is used. The first one or two reactors in series would contain the HDT catalyst, while the last, and perhaps all or a portion of the second reactor, would contain the Zeolite Beta catalysts.

It may be beneficial to adjust up or down reactor temperature in a second reaction zone, relative to a first reaction zone. Temperature adjustment of the reaction zone is a very good way to accommodate for different relative aging rates of the HDT and Zeolite Beta catalysts, or to acommodate peculiarities of the local installation, where it is desired to adjust the relative amount of reaction occurring in each reaction zone by adjusting the temperature. Overall, an object of the invention is to operate the two reaction zones to reduce the highest temperature of either reaction zone.

The ratio of the catalyst in the hydrotreating zone to the catalyst in the dewaxing zone is less than 2:1, a ratio of about 1:2 being desirable.

Additional modifications to the cascade operation of this invention are shown in the drawings.

Understanding of this invention will be facilitated by reference to the following examples, in which parts and percentages are by weight unless expressly stated to be on some other basis. The examples are illustrative only and in no way limiting upon the scope of this invention.

EXAMPLES

Experiments are performed with respect to this invention. Table 1 shows the catalyst properties for both the hydrotreating and Zeolite Beta catalyst used in the experiments. Table 2 describes the feedstock properties treated by the catalyst described in Table 1. Tables 1 and 2 are reproduced below:

TABLE 1

| | Catalyst Properties | |
|---|---|---|
| Catalyst | Hydrotreating (HDT) | Pt-Zeolite Beta |
| Composition | | |
| Extrudate, wt % | | |
| Zeolite Beta | — | 50 |
| $Al_2O_3$ | 100 | 50 |
| Metals, wt % | | |
| Platinum | — | 0.6 |
| NiO | 20.5 | — |
| $MoO_3$ | 5.0 | — |
| Properties | | |
| Packed Density, gm/cc | 0.83 | 0.54 |
| Surface Area, $m^2/gm$ | 160 | 335 |
| Pore Volume, cc/gm | 0.44 | 0.745 |

TABLE 2

| Feedstock Properties | |
|---|---|
| Gravity, °API | 29.9 |
| Pour Point, °F. | 90 |
| Sulfur, wt % | 0.16 |
| Nitrogen, ppm | 120 |
| Distilation, °F. | |
| Initial Boiling Point | 460 |
| 10% vol. | 571 |
| 30% vol. | 635 |
| 50% vol. | 682 |
| 70% vol. | 705 |
| 90% vol. | 785 |
| End Point | 858 |

The following experiments are conducted using the catalysts described in Table 1 and utilizing the feedstock described in Table 2. The purpose behind the experiments described in Table 3 is to show the effect of cascade operation utilizing a two-component hydrotreating/Zeolite Beta catalyst system and to show a comparison of those effects with treatment of the feedstock using the Zeolite Beta catalyst alone. The ratio of hydrotreating catalyst to Zeolite Beta catalyst is shown in the Table. Processing of the feedstock in each of the systems described, cascade or non-cascade, is conducted according to the conventional processing described in the preceding disclosure. FIG. 1 schematically depicts the processing equipment configuration for cascade operation without interstage gas purification. The portion of the experiment conducted without the hydrotreating catalyst would have a similar configuration, except that the hydrotreating catalyst bed would be absent. The results shown in Table 3 show a reduction in the Zeolite Beta dewaxing temperature for cascade operation, compared to operation using the Zeolite Beta catalyst alone. The Table also shows a substantial reduction in hydrogen consumption. The effect of cascade operation, based on the information obtained from the experimentation described in Table 3, is that lower operating temperatures in cascade-type operation permit longer cycles, longer catalyst life, and consequent reduction in the catalyst cost, which is further reduced through the use of less expensive hydrotreating catalyst. Table 3 follows:

TABLE 3

Comparison of Cascade Operation With Pt Zeolite Beta Alone

| | Pt Zeolite Beta | | Cascade (HDT/ Pt Zeolite Beta) | |
|---|---|---|---|---|
| HDT/Pt Zeolite Beta (v/v) | 0/1 | 0/1 | 1/2 | 1/2 |
| Interstage Gas Separation | — | — | No | No |
| Operating Conditions | | | | |
| $H_2$ Pressure, psia | 400 | 400 | 400 | 400 |
| LHSV (overall) | 0.67 | 1.0 | 0.67 | 1.0 |
| Temperature, °F. | | | | |
| HDT | — | — | 733 | 749 |
| Pt Zeolite Beta | 752 | 763 | 744 | 760 |
| Average | 752 | 763 | 740 | 756 |
| Product Yields, wt % | | | | |
| $C_1$–$C_3$ | 1.0 | 1.0 | 0.4 | 0.3 |
| $C_4$ | 1.6 | 1.6 | 0.4 | 0.3 |
| $C_5$–330° F. Gasoline | 7.0 | 7.0 | 3.3 | 3.3 |
| 330° F.+ Distillate | 90 | 90 | 96 | 97 |
| $H_2$ Consumption, SCF/B | 250 | 250 | 150 | 150 |
| 330° F.+ Distillate Properties | | | | |
| Gravity, °API | 31 | 31 | 32 | 31 |
| Pour Point, °F. | 20 | 20 | 20 | 20 |
| Sulfur, wt % | 0.08 | 0.08 | 0.01 | 0.02 |
| Nitrogen, ppm | 110 | 110 | 80 | 100 |

As shown in the Table, distillate yields from cascade operation show an improvement over non-cascade operation.

Further experiments are conducted to show the effect of hydrogen partial pressure on cascade and non-cascade operation. The experiments were performed utilizing the same procedures employed in the preceding experiments. Again, the Tables show reduction in Zeolite Beta dewaxing temperature when utilizing cascade operation, rather than non-cascade operation. The experiments show a reduction in hydrogen consumption as well as improved distillate yields, with dramatic improvement in yield for the same hydrogen partial pressure and less loss of yield as pressure increases. Table 4 shows:

TABLE 4

Effect of Pressure on Cascade and Pt ZSM-Beta Alone

| | Pt Zeolite Beta | | Cascade (HDT/ Zeolite Beta) | |
|---|---|---|---|---|
| HDT/Pt Zeolite Beta (v/v) | 0/1 | 0/1 | 1/2 | 1/2 |
| Interstage Gas Separation | — | — | No | No |
| Operating Conditions | | | | |
| $H_2$ Pressure, psia | 400 | 600 | 400 | 600 |
| LHSV (overall) | 0.67 | 0.67 | 0.67 | 0.67 |
| Temperature, °F. | | | | |
| HDT | — | — | 733 | 725 |
| Pt Zeolite Beta | 752 | 770 | 744 | 725 |
| Average | 752 | 770 | 740 | 725 |
| Product Yields, wt % | | | | |
| $C_1$–$C_3$ | 1.0 | 1.5 | 0.4 | 0.4 |
| $C_4$ | 1.6 | 2.4 | 0.4 | 0.7 |
| $C_5$–330° F. Gasoline | 7.0 | 19 | 3.3 | 7.9 |
| 330° F.+ Distillate | 90 | 77 | 96 | 91 |
| $H_2$ Consumption, SCF/B | 250 | 400 | 150 | 300 |
| 330°F. + Distillate Properties | | | | |
| Gravity, °API | 31 | 33 | 32 | 32 |
| Pour Point, °F. | 20 | 20 | 20 | 20 |
| Sulfur, wt % | 0.08 | 0.08 | 0.02 | 0.004 |
| Nitrogen, ppm | 110 | 95 | 80 | 17 |

Figure 2:
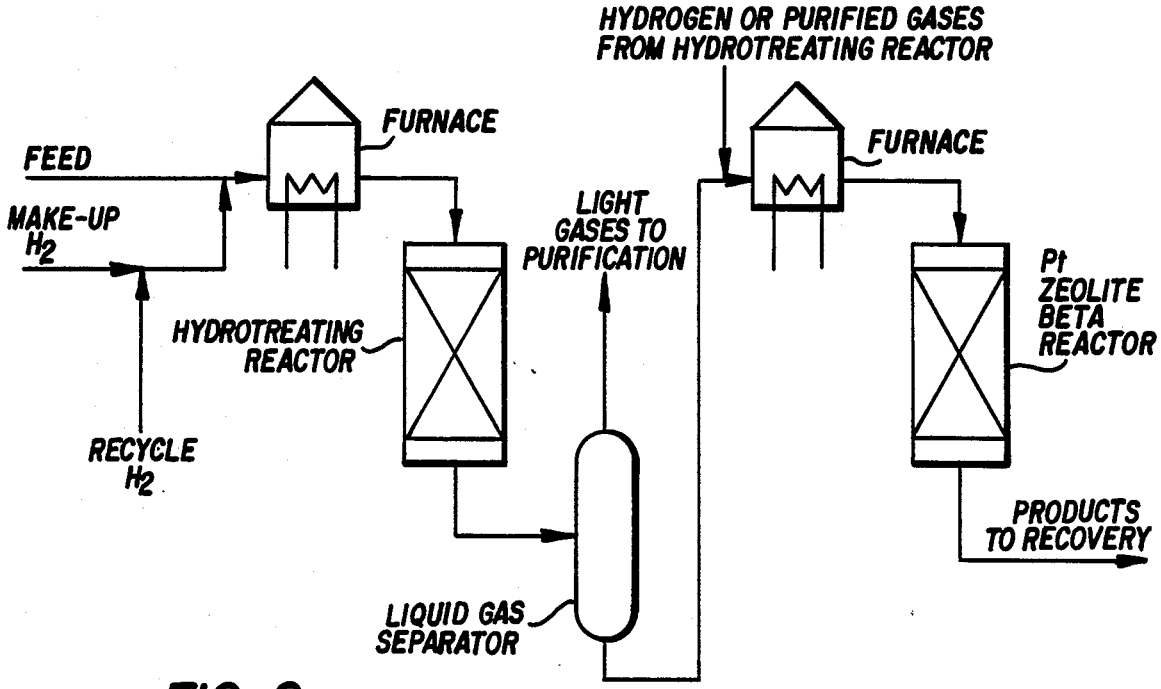
FIG. 2 shows a process configuration where the products of the first catalyst bed are flashed to removed light gases. Gases are purified. The purified gases may be combined with recycle or make-up gas to increase hydrogen partial pressure of the gas going to the second reactor.

Table 5 shows the effect of hydrotreating catalyst temperature on cascade operation. The experiments shown in Table 5 are conducted utilizing the experimental procedures employed in the preceding experimentation and described above. A schematic depiction for a processing equipment configuration for cascade operation utilizing interstage gas purification is shown in FIG. 2. The experiments show that as the temperature of the hydrotreating catalyst is reduced, the temperature of the Zeolite Beta catalyst increases. However, the improved distillate yields, with respect to the results obtained from the Pt. Zeolite Beta experiments depicted in Table III, are maintained. The increase in the temperature of the Zeolite Beta catalyst, however, can be minimized by utilizing interstage gas purification, which enhances the beneficial effects of the invention. Table 5 again shows the reduced hydrogen consumption achieved with cascade operation utilizing a combined hydrotreating and Zeolite Beta catalyst system and also shows the enhanced distillate yields obtained by this invention. Table 5 shows:

TABLE 5

Effect of HDT Catalyst Temperature on Cascade Operation

| | | | |
|---|---|---|---|
| HDT/Pt Zeolite Beta (v/v) | 1/2 | 1/2 | 1/2 |
| Interstage Gas Separation | No | No | Yes |
| Operating Conditions | | | |
| $H_2$ Pressure, psia | 400 | 400 | 400 |
| LHSV (overall) | 0.67 | 0.67 | 0.67 |
| Temperature, °F. | | | |

TABLE 5-continued

| Effect of HDT Catalyst Temperature on Cascade Operation | | | |
|---|---|---|---|
| HDT | 733 | 671 | 664 |
| Pt Zeolite Beta | 744 | 753 | 746 |
| Average | 740 726 | 719 | |
| Product Yields, wt % | | | |
| $C_1$–$C_3$ | 0.4 | 0.2 | 0.4 |
| $C_4$ | 0.4 | 0.2 | 0.5 |
| $C_5$–330°F. Gasoline | 3.3 | 2.6 | 4.0 |
| 330° F.+ Distillate | 96 | 97 | 95.0 |
| $H_2$ Consumption, SCF/B | 150 | 100 | 70 |
| 330° F. + Distillate Properties | | | |
| Gravity, °API | 32 | 31 | 31 |
| Pour Point, °F. | 20 | 20 | 20 |
| Sulfur, wt % | 0.01 | 0.04 | 0.01 |
| Nitrogen, ppm | 80 | 100 | 70 |

A comparison of the results obtained from the experiments described in Tables 3–5, with the information contained for the feedstock described in Table 2, shows the reduction in pour point between the feedstock and the distillate obtained from the cascade operation described above.

It is not intended to limit the present invention to the specific embodiments described above. It is recognized that other changes may be made in the steps of the cascade process specifically described herein without deviating from the scope and teachings of the present invention. It is intended to encompass all other embodiments, alternatives and modifications consistent with the present invention.

We claim:

1. In a process for dewaxing a waxy hydrocarbon feedstock containing waxy paraffins, normal paraffins, slightly branched paraffins, sulfur and nitrogen compounds over a dewaxing catalyst containing Zeolite Beta alone in a reactor of specified volume, the improvement comprising:

(a) substituting a portion of the said dewaxing catalyst in said reactor volume with a hydrotreating catalyst to form a distinct hydrotreating zone and a dewaxing zone, the ratio of the catalyst in the hydrotreating zone to the catalyst in the dewaxing zone being at least 1:2, but less than 2:1 to maintain a specified reactor volume;

(b) subjecting said feedstock to hydrotreating by contacting said feedstock with the hydrotreating catalyst in said hydrotreating zone operated at hydrotreating conditions sufficient to remove at least a portion of said sulfur and nitrogen compounds from the feedstock;

(c) subjecting said hydrotreated feedstock to catalytic dewaxing without changing the hydrogen partial pressure by contacting said feedstock with the dewaxing catalyst in the dewaxing zone containing Zeolite Beta and a hydrogenation/dehydrogenation component; and (d) recovering a distillate having a reduced pour point compared to said feedstock at higher yield and with reduced hydrogen consumption than a process using the said dewaxing catalyst alone.

2. The process according to claim 1 where the hydrogen partial pressure at the inlet of the dewaxing zone is adjusted to the same hydrogen partial pressure as at the inlet of the hydrotreating zone.

3. The process according to claim 1, in which the feedstock also includes aromatic components.

4. The process according to claim 1, in which the hydrogenation/dehydrogenation component comprises a noble metal of Group VIIIA of the Periodic Table.

5. The process according to claim 4, in which the hydrogenation/dehydrogenation component comprises 0.01 to 5 wt % on an elemental basis, of platinum or palladium.

6. The process according to claim 1, in which the hydrogenation/dehydrogenation component comprises metals of nickel, cobalt, molybdenum, tungsten and mixtures thereof.

7. The process according to claim 1, further comprising contacting the feedstock with the catalysts in the presence of hydrogen at temperatures from about 550° F. to 900° F., a hydrogen partial pressure from about 200 to 2000 psia and space velocities (LHSV) from 0.1 to 10 $hr^{-1}$.

8. The process according to claim 7, further comprising contacting the feedstock with the catalysts in the presence of hydrogen at temperatures from about 650° F. to 850° F., a hydrogen partial pressure from about 200 to 1000 psia and space velocities (LHSV) from 0.1 to 5 $hr^{-1}$.

9. The process according to claim 1, wherein said feedstock, prior to hydrotreating, contains up to 30,000 wt ppm sulfur, 20,000 wt ppm nitrogen and at least 10 wt % waxy components of normal paraffins and slightly branched chain paraffins.

10. The process according to claim 1, wherein said hydrotreating catalyst comprises Co-Mo, Ni-Mo or Ni-W on alumina.

11. The process according to claim 1, further comprising locating the hydrotreating zone and dewaxing zone in one reactor.

12. The process according to claim 1, further comprising locating the hydrotreating zone and dewaxing zone in different reactors.

13. The process according to claim 1, in which the ratio of dewaxing catalyst to hydrotreating catalyst is 2:1.

14. A process for dewaxing a waxy hydrocarbon feedstock and containing at least 10 wt % waxy paraffins including normal paraffins and slightly branched paraffins, and sulfur and nitrogen compounds by catalytically dewaxing the feedstock over a zeolite beta dewaxing catalyst which has been partially substituted with a hydrotreating catalyst to form a hydrotreating zone comprising:

(a) subjecting said feedstock to hydrotreating by contacting said feedstock with said substituted hydrotreating catalyst in said hydrotreating zone operated at a temperature of about 600° F. to 850° F., a hydrogen partial pressure of about 200 psia to 1000 psia, and a liquid hourly space velocity of about 0.1 to 5, to remove at least a portion of said sulfur and nitrogen compounds from the feedstock;

(b) subjecting said hydrotreated feedstock to catalytic dewaxing without changing the hydrogen partial pressure by contacting said feedstock with said dewaxing catalyst in said dewaxing reactor, containing Zeolite Beta and a hydrogenation/dehydrogenation component, including a temperature of about 600° F. to 850° F., a hydrogen partial pressure of about 200 psia to 1000 psia, and a liquid hourly space velocity of about 0.1 to 5, the ratio of the catalyst in the dewaxing zone to the catalyst in the hydrotreating zone being about 2:1; and (c) recovering a, product of middle and heavy distillate.

15. The process according to claim 14, in which the hydrogenation/dehydrogenation component comprises 0.1 to 5 wt %, on an elemental basis, of platinum or palladium.

16. The process according to claim 14, in which the hydrogenation/dehydrogenation component comprises 0.1. to 20 wt %, on an elemental basis, of nickel or tungsten, or both.

17. The process according to claim 14, in which the hydrotreating catalyst is a Co-Mo, Ni-Mo or Ni-W on alumina.

18. The process according to claim 14, wherein said substituting further comprising locating the hydrotreating zone and dewaxing zone in different reactors.

19. The process according to claim 14, whereby the replacement of Zeolite Beta by a hydrotreating catalyst is in an amount such that distillate yield is improved and processing temperatures are reduced compared to known processes utilizing only Zeolite Beta.

* * * * *